US006189587B1

(12) United States Patent
Cairns

(10) Patent No.: US 6,189,587 B1
(45) Date of Patent: Feb. 20, 2001

(54) AUTOMATED TAPE SPLICING SYSTEM

(75) Inventor: John Cairns, St. Laurent (CA)

(73) Assignee: Intertape Polymer Group, Quebec (CA)

( * ) Notice: Under 35 U.S.C. 154(b), the term of this patent shall be extended for 0 days.

(21) Appl. No.: 09/234,312

(22) Filed: Jan. 21, 1999

(30) Foreign Application Priority Data

Jan. 21, 1998 (CA) ..... 2227668

(51) Int. Cl.[7] ..... B65H 19/16

(52) U.S. Cl. ..... 156/351; 156/505; 156/157; 156/360

(58) Field of Search ..... 156/351, 353, 156/360, 361, 378, 157, 505, 504, 502; 242/475.5, 554.2, 555, 555.3

(56) References Cited

U.S. PATENT DOCUMENTS

| | | | | |
|---|---|---|---|---|
| 3,567,534 | * | 3/1971 | Kushiro | 156/157 |
| 4,238,261 | * | 12/1980 | Tetro | 156/157 |
| 4,643,783 | * | 2/1987 | Hogenson | 156/64 |
| 5,573,626 | * | 11/1996 | Rossini et al. | 156/361 |
| 5,676,792 | | 10/1997 | Cairns . | |

* cited by examiner

*Primary Examiner*—Richard Crispino
*Assistant Examiner*—George R. Koch, III
(74) *Attorney, Agent, or Firm*—Sughrue, Mion, Zinn, Macpeak & Seas, PLLC

(57) ABSTRACT

A multi-roll automatic tape splicing device includes a platen which is rotatably mounted on a support frame via a shaft. Two or more tape mandrels are rotatably disposed on the platen at a substantially equal distance from the shaft, and substantially equally spaced from each other, each mandrel being capable of receiving a respective roll of tape. An index drive is operatively coupled to the platen, for selectively rotating the platen so as to successively move each mandrel into a predetermined operating position at which a web of tape can be drawn from a respective roll of tape disposed on the mandrel, and for moving a mandrel out of the operating position when the respective roll of tape is depleted. A first sensor is operatively mounted on the support frame and capable of detecting a depleted condition of a roll of tape mounted on a respective mandrel in the operating position. A second sensor is operatively mounted on the support frame and capable of detecting rotation of a mandrel in the operating position. A cutting unit is disposed on the frame and capable of severing a web of tape being drawn from a depleted roll of tape. A control unit is responsive to the first and second sensors such that when the first sensor detects a depleted condition of a roll of tape, the control unit controls the index drive to rotate the platen and thereby move the next successive mandrel into the operation position. A tab formed on the end of a fresh roll of tape mounted on the successive mandrel adheres to the web of tape being drawn from the depleted roll, thereby causing a web of tape to be drawn from the fresh roll. Thereafter, the control unit controls the cutting unit to cut the web of tape being drawn from the depleted roll, when the second sensor detects rotation of the mandrel in the operation position.

12 Claims, 4 Drawing Sheets

AUTOMATED TAPE SPLICING SYSTEM

CROSS-REFERENCE TO RELATED APPLICATIONS

This application is based on, and claims priority from, Canadian Patent Application No. 2,227,668, filed Jan. 21, 1998.

MICROFICHE APPENDIX

Not applicable

SUMMARY OF THE INVENTION

This invention relates to a tape splicing device, and in particular to a device for automatically splicing adhesive tape used in a carton sealing machine.

Conventional machines currently used to seal cartons, such as, for example, corrugated cardboard cartons, typically include a work table or frame, the top of which is defined by rollers for slidably receiving cartons. A pair of opposed drive belts frictionally engage the sides of each carton, and feed the carton along the length of the machine between upper and/or lower tape dispensing heads, which respectively apply tape to the top and/or bottom and ends of the cartons. The tape is dispensed from rolls mounted on arms extending upwardly and/or downwardly from the dispensing heads. When the tape in a roll runs out, it is necessary to stop the machine and replace the used roll with a new roll of tape.

It is preferable to avoid stopping the machine. A proposed solution to the problem is the use of a stack of interconnected rolls of tape. However, this solution necessitates a complicated structure for interconnecting the rolls and merely reduces the frequency of machine stoppage. In co-owned U.S. Pat. No. 5,676,792, the teaching of which is hereby incorporated by reference, the present inventor teaches a tape splicing device which is capable of providing a continuous web of tape to a carton sealing machine. The device of U.S. Pat. No. 5,676,792 comprises a pair of tape spindles mounted on a pivoting arm for receiving respective rolls of tape. In operation, tape is drawn from one of the rolls and is fed to a tape dispensing head. When the roll is nearly exhausted, an operator causes the pivoting arm to rotate through approximately 180 degrees. Rotation of the arm brings a fresh roll of tape on the other spindle into contact with the web of tape. A tab formed on the fresh roll of tape adheres to the web, thereby causing a web of tape to be drawn from the fresh roll. At this point the web of tape from the exhausted roll can be cut, such as, for example, by a knife, and the web of tape continues to be drawn from the fresh roll. The operator can then replace the exhausted roll of tape with a fresh roll of tape without interfering with the web of tape being drawn from the fresh roll. By way of this operation, a continuous web of tape can be supplied to a tape head in a carton sealing machine, thereby facilitating continuous, uninterrupted operation of the carton-sealing operation.

A disadvantage of the above-described device is that its operation is dependent on intervention by an operator, thereby rendering the device undesirably labor-intensive and prone to human error.

Thus an object of the present invention is to provide a fully automatic tape splicing device capable of operation for extended periods of time with minimal intervention from an operator.

Accordingly, the present invention provides a multi-roll automatic tape splicing device in which a platen is rotatably mounted on a support frame via a shaft. At least two tape mandrels are rotatably disposed on the platen at a substantially equal distance from the shaft, and substantially equally spaced from each other, each mandrel being capable of receiving a respective roll of tape. An index drive is operatively coupled to the platen, for selectively rotating the platen so as to successively move each mandrel into a predetermined operating position at which a web of tape can be drawn from a respective roll of tape disposed on the mandrel, and for moving a mandrel out of the operating position when the respective roll of tape is depleted. A first sensor is operatively mounted on the support frame and capable of detecting a depleted condition of a roll of tape mounted on a respective mandrel in the operating position. A second sensor is operatively mounted on the support frame and capable of detecting rotation of a mandrel in the operating position. A cutting unit is disposed on the frame and capable of severing a web of tape being drawn from a depleted roll of tape. A control unit is responsive to the first and second sensors such that when the first sensor detects a depleted condition of a roll of tape the control unit controls the index drive to rotate the platen and thereby move the next successive mandrel into the operation position. A tab formed on the end of a fresh roll of tape mounted on the successive mandrel adheres to the web of tape being drawn from the depleted roll, thereby causing a web of tape to be drawn from the fresh roll. Thereafter, the control unit controls the cutting unit to cut the web of tape being drawn from the depleted roll, when the second sensor detects rotation of the mandrel in the operation position.

The platen can be provided with as few as two mandrels, although three or more mandrels are preferred because the use of more mandrels increases the number of tape splicing cycles which may be completed before an operator must install fresh rolls of tape.

The platen can be mounted for rotation either horizontally, or vertically (or at an angle). Furthermore, the frame can be constructed as a free-standing unit, or can be designed to be mounted onto a conventional carton sealing machine.

In an embodiment of the invention, the apparatus comprises a single splicing unit composed of an index drive, platen and cutter unit. Alternatively, two or more splicing units can be assembled onto a single frame, so that a plurality of tape heads can be supplied from a single tape splicing device. In this case, each splicing unit may have its own control unit, or, all splicing units may be controlled by a single control unit.

BRIEF DESCRIPTION OF THE DRAWINGS

Further features and advantages of the present invention will become apparent from the following detailed description, taken in combination with the appended drawings, in which.

DETAILED DESCRIPTION

In the following, the present invention is described and illustrated by way of a floor-mounted embodiment having three mandrels mounted on a horizontally rotating platen. While this illustrated embodiment is fully operative, it will be understood that the present invention is in no way limited to such embodiment. For example, the skilled artisan will recognize that the device of the present invention can be designed to be mounted on any suitable supporting structure, which may include a frame of a carton sealing machine. Similarly, the platen can be arranged to rotate in either a horizontal or an angled plane. Furthermore, while three mandrels are used in the illustrated embodiment, the present invention can be operated with as few as two mandrels, or as many as four or more mandrels. Thus it will be seen that the embodiment described in detail herein is illustrative, rather than being limitative of the present invention.

Figure 1:
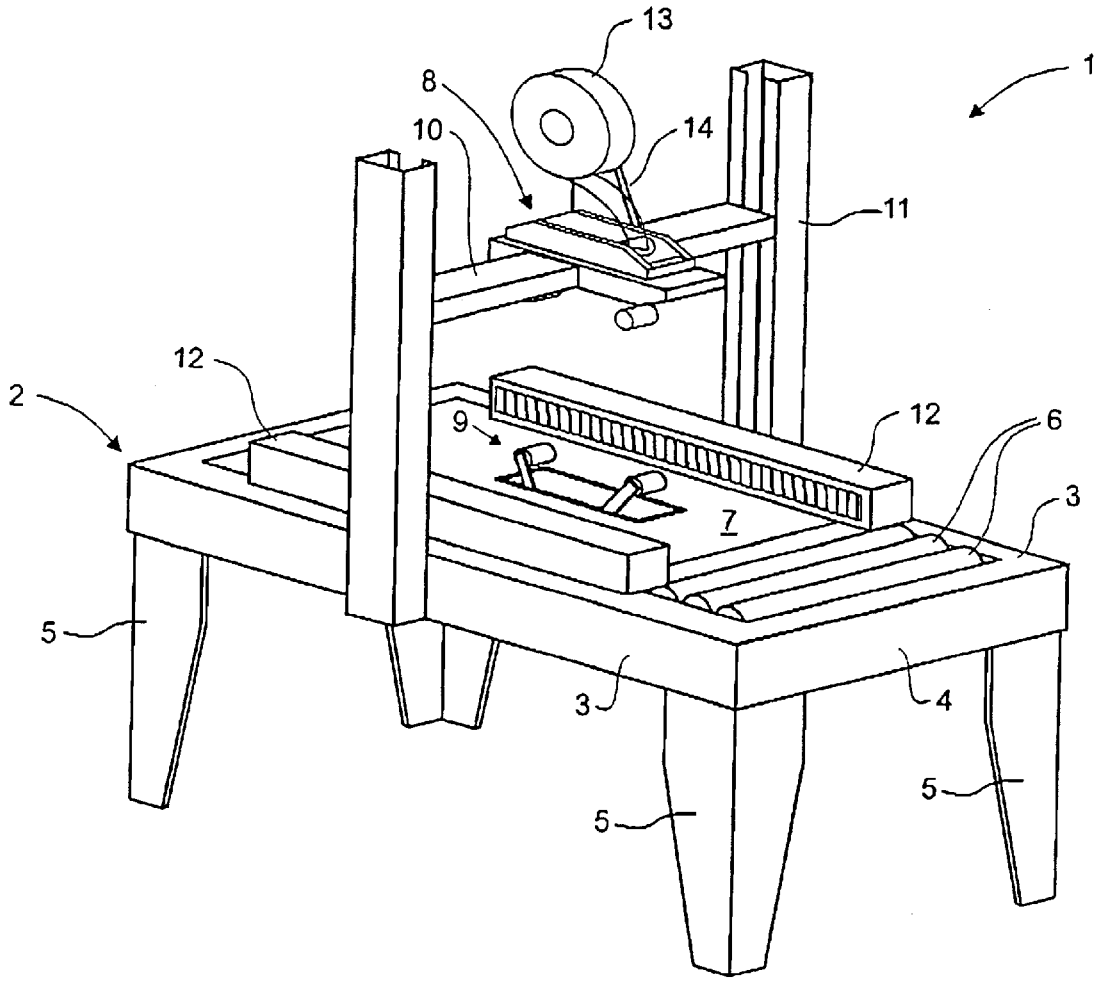
Figure 1 (Prior Art)
FIG. 1 is a schematic, isometric view of a conventional carton sealing machine of the general type with which the device of the present invention can be used.

With reference to FIG. 1, the automatic tape splicing device of the present invention is intended for use in conjunction with a machine designed to seal cartons, such as, for example, corrugated cardboard cartons (not shown) of the type commonly used for storing and shipping various materials and articles. The machine 1 includes a main frame 2 defined by side members 3 and end members 4 supported at the corners by legs 5. The frame 2 includes a plurality of rollers 6 defining a guide surface 7 for slidably supporting cartons during taping thereof by identical upper and lower tape heads 8 and 9. The upper tape head 8 is mounted on a crossbar 10 extending between support posts 11 which are securely connected to and supported by the side members 3 of the frame 2. The lower tape head 9 is mounted in an opening in the guide surface 7 defined by the rollers 6. Motor-driven endless belt assemblies 12 or similar driving systems are disposed proximal the sides of the guide surface 7, on either side of the path of travel of the cartons for driving the latter between the tape heads 8 and 9.

Typically, each of the tape heads 8, 9 carries a respective roll of tape 13 (only one is shown in FIG. 1 ) supported by a respective arm 14 which extends from each tape head 8 and 9. When a roll of tape 13 is depleted, the machine 1, and thus the entire carton sealing operation, must be stopped while the depleted roll is replaced. When an automated tape splicing machine in accordance with the present invention is used, the arm 14 carrying the roll of tape 13 is replaced by one or more rollers (not shown) which act to guide a web of tape from the automated tape splicing machine and into the tape head 8, 9 at and angle and orientation similar to that which is obtained when the tape is drawn from a roll 13 conventionally mounted on the tape head as illustrated in FIG. 1. By this means, the carton sealing machine 1 can be suitably adapted to receive tape continuously delivered to the tape heads with minimal modification of the tape-heads themselves. This allows the automated tape splicing machine of the present invention to be readily incorporated into existing production lines while minimizing the cost of modifying existing carton sealing equipment.

In the following description, a single automatic tape splicing machine is described for supplying tape to the lower tape head 9 of a carton sealing machine 1. However, it will be understood that a similar arrangement will advantageously be provided for supplying tape to the upper tape head, the only significant difference being the provision of suitable rollers for guiding the web of tape to the respective tape heads. It is considered that the introduction of such additional rollers will be well within the purview of one skilled in the art.

Referring now to FIGS. 2, 3, and FIGS. 4*a*–4*d*, the automatic tape splicing machine 15 of the present invention generally comprises a platen 16 rotatably mounted on a support frame 17 via a shaft 18. Tape mandrels 19 are rotatably disposed on the platen 16 at a substantially equal distance from the shaft 18, and substantially equally spaced from each other. Each mandrel 19 is designed to securely retain a respective roll 20 of tape, and to rotate as a web of tape 21 is pulled from a corresponding roll 20. In the illustrated embodiment, the platen 16 is configured generally as an equilateral triangle with the shaft 18 located at its centroid. The three mandrels 19*a*–19*c* are mounted proximal respective vertices of the triangular platen 16. In an embodiment having four mandrels 19, the platen 16 would conveniently be square or X-shaped, with mandrels 19 being mounted at respective corners. The platen 16 serves to provide a rotatable mounting platform for supporting the mandrels 19 (and respective rolls of tape 20) and can be fabricated of any convenient material providing suitable strength, rigidity and resilience, such as, for example, steel or aluminum plate.

An index drive 22 is operatively coupled to the platen 16, either directly or via the shaft 18, for selectively rotating the platen 16 in the manner described in further detail below. The index drive 22 can be powered by convenient means, such as, for example, using an electric motor coupled to the shaft by way of a suitable gear, belt, chain or similar power transmission unit. Alternatively, a pneumatically or hydraulically powered drive unit can be provided. The index drive 22 is controlled by a suitable control unit 23 to hold the platen 16 in a fixed condition so that a mandrel 19*a* is maintained at a predetermined "active position" (at the top, in each of FIGS. 4*a*–4*d*) while a web of tape 21*a* is pulled from a respective roll 20*a* mounted on that mandrel 19*a*. When the supply of tape on the roll 20*a* is depleted, the index drive 22 rapidly rotates the platen 16 to bring the next mandrel 19*b* carrying a fresh roll of tape 20*b* into the active position so that a web of tape 21*b* can be pulled therefrom. This operation will be described in greater detail below.

A depleted roll sensor 24, is operatively mounted on a suitable bracket 25 secured to the support frame 17 proximal the active position. The depleted roll sensor 24 is arranged to detect a depleted condition of a roll of tape 20 from which a web 21 of tape is being drawn. The depleted roll sensor 24 can conveniently be provided as an opto-emitter/photo-detector combination arranged, for example, to detect a depleted condition of the roll of tape by reflecting light off the roll in question. In this situation, while the photo-detector detects a reflected light, it is determined that the roll of tape has not yet reached a depleted condition. Conversely, when a reflected light is not detected, it is determined that the roll of tape has reached a depleted condition. In an alternative arrangement, the photo-detector and opto-emitter can be arranged on opposite sides of the roll of tape, so that a full roll of tape will interrupt the light path between the emitter and the photo-detector In this case, if the photo-detector detects light from the emitter, it is determined that the roll of tape has reached a depleted condition.

As a further alternative, the depleted roll sensor 24 could be provided as an idler wheel mounted on a spring-loaded arm and running on the roll of tape in the active position. Thus the angle of the spring-loaded arm is indicative of the amount of tape remaining on the roll, and a depleted condition of the roll of tape can be indicated by a micro-switch suitably positioned to be activated by the spring-loaded arm.

In any of the above arrangements, the depleted roll sensor 24 generates a signal indicative of whether or not the roll of tape has reached a depleted condition, and transmits this signal to the control unit 23 by a suitable conductor (not shown).

A rotation sensor 26 is also operatively mounted on the support bracket 25 and arranged to detect rotation of a mandrel 19 in the active position. The rotation sensor 26 can be conveniently provided as a conventional emitter/detector unit arranged to detect light reflected from suitable reflective indices (not shown) formed on the mandrel 19, or to detect light passing through holes or slots (not shown) suitably formed in the mandrel 19. Alternatively, the rotation sensor 26 can be provided as a conventional Hall-effect sensor. With any of the above arrangements, the rotation sensor 26 generates a signal indicative of rotation of the mandrel 19 in the active position, and transmits this signal to the control unit 23 by a suitable conductor.

Figure 5A:
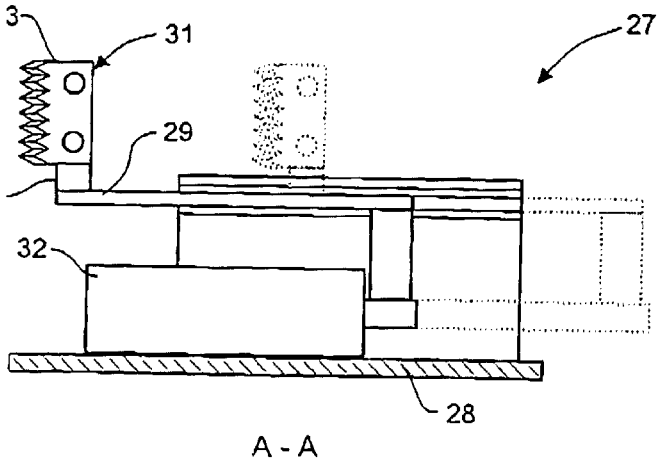
FIGS. 5*a* and 5*b* respectively show a partially sectioned side view and an end view illustrating a cutting unit usable in the automatic tape splicing machine of FIGS. 2 and 3.
Figure 5B:
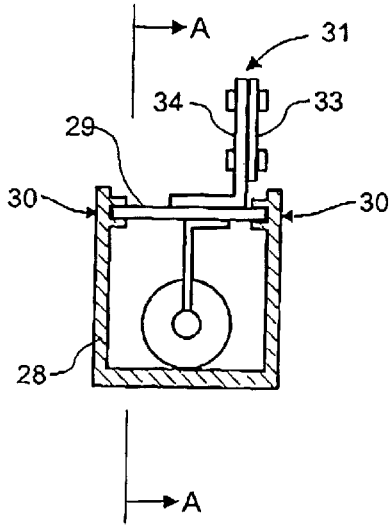

A cutting unit 27 is disposed on the frame 17 for severing a web of tape 21*a* being drawn from a depleted roll of tape 20*b* (see FIGS. 4*a*–4*d*). In the embodiment illustrated in FIG. 5, the cutting unit 27 generally comprises a housing 28 secured to the frame 17, a slider plate 29 slidably disposed on tracks 30 of the housing 28, a knife assembly 31 mounted on a forward end of the slider plate 29, and an actuator unit 32 for driving the slider plate 29 and knife assembly 31 between a retracted position (shown in dotted lines in FIG. 5) and a cutting position (shown in solid lines in FIG. 5). The knife assembly 31 includes a knife blade 33 securely retained on the slider plate 29 by a knife carrier 34. The housing 28, slider plate 29 and knife carrier 34 can conveniently be constructed of any conveniently suitable material, such as, for example, steel, aluminum, or suitable plastic. The knife blade 33, which will conveniently be formed of high-strength steel to provide a long-lasting edge, is secured to the knife carrier 34 by any suitable means, such as, for example, by means of nuts, bolts or screws.

The actuator unit 32 can conveniently be provided as a conventional linear actuator driven by hydraulic or pneumatic power, or alternatively could be provided as an electromagnetically activated solenoid.

Figure 2:
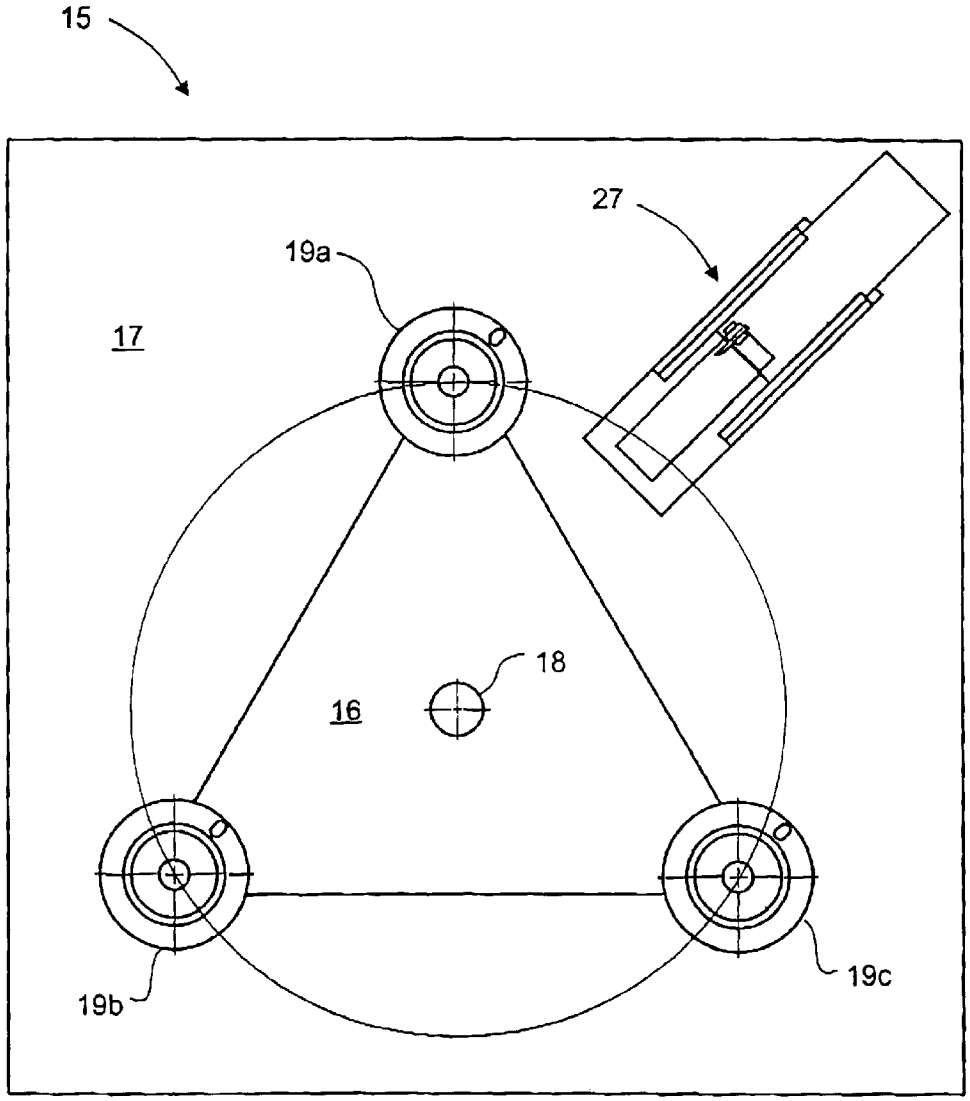
FIG. 2 shows a top view of an automatic tape splicing machine in accordance with an embodiment of the present invention.
Figure 3:
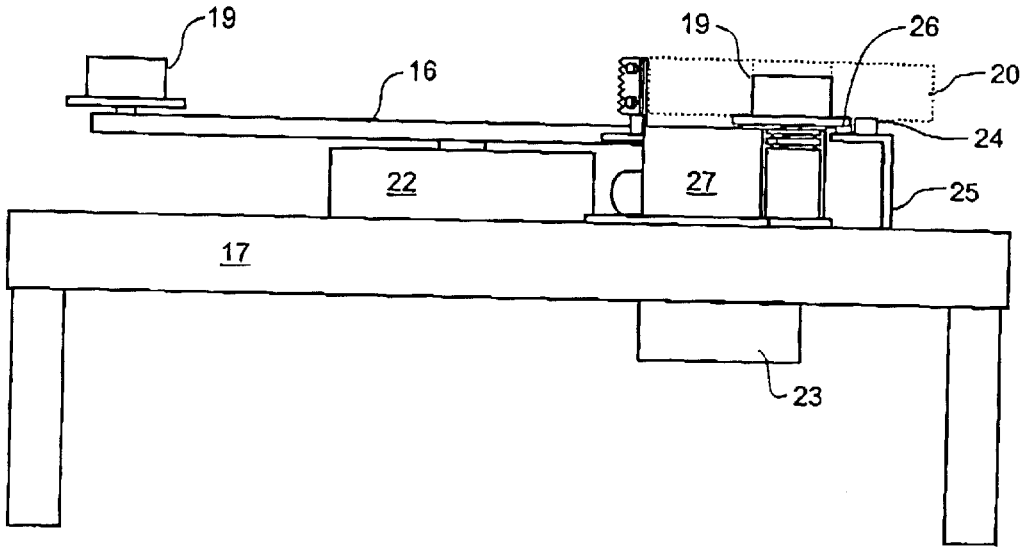
FIG. 3 shows a side view of the automatic tape splicing machine of FIG. 2.

As shown in FIGS. 2, 3 and 4, the cutting unit 27 is arranged behind the operating position of the platen 16 as seen from the direction of rotation of the platen 16, and knife blade 33 is held, in the retracted position. outside the path of a mandrel 19 as the platten 16 is rotated. With this arrangement, when the platen 16 rotates to bring a fresh roll of tape 20*b* into the active position, the mandrel 19*a* carrying the depleted roll 20*a* is moved past the cutting unit 27. Following rotation of the platen 16, the web of tape 21*a* streaming from the depleted roll 20*a* lays across the path of motion of the knife assembly 31, so that the knife blade 33 will sever the web of tape 21*a* when the actuator unit 32 is activated to slide the knife assembly 31 from the retracted position to the cutting position. Following the severing of the tape 21*a* from the depleted roll 20*a*, the knife actuator 32 returns the knife assembly 31 to the retracted position in preparation for the next rotation cycle of the platen 16.

The control unit 23 is operatively mounted on the support frame 17 for controlling rotation of the platen 16 and activation of the cutting unit 27. The control unit 23 is conveniently provided as a microprocessor circuit operating under suitable program control, and includes input jacks for receiving signals from each of the depleted roll and rotation sensors 24 and 26. Alternatively, the control unit could comprise a relay circuit responsive to the signals from the depleted roll and rotation sensors 24 and 26. In general, the control unit 23 is responsive to the signals generated by the depleted roll and rotation sensors 24 and 26 to provide the following operation sequence, as illustrated in FIGS. 4*a*–*d*.

Figure 4A:
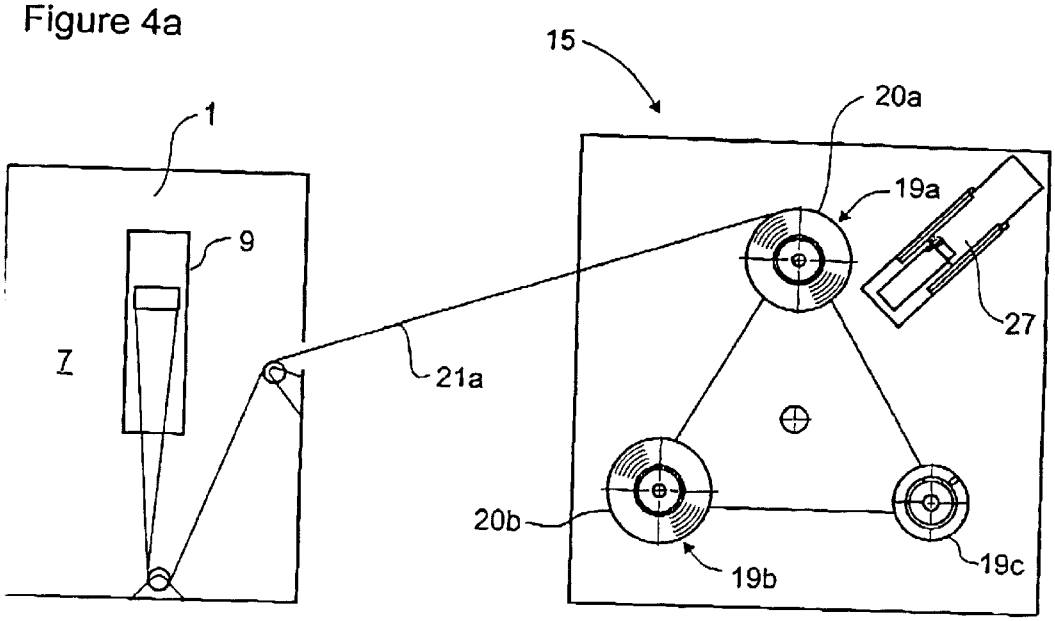
FIGS. 4*a*–4*b* schematically illustrate steps in the operation of the automatic tape splicing machine of FIGS. 2 and 3.
Figure 4B:
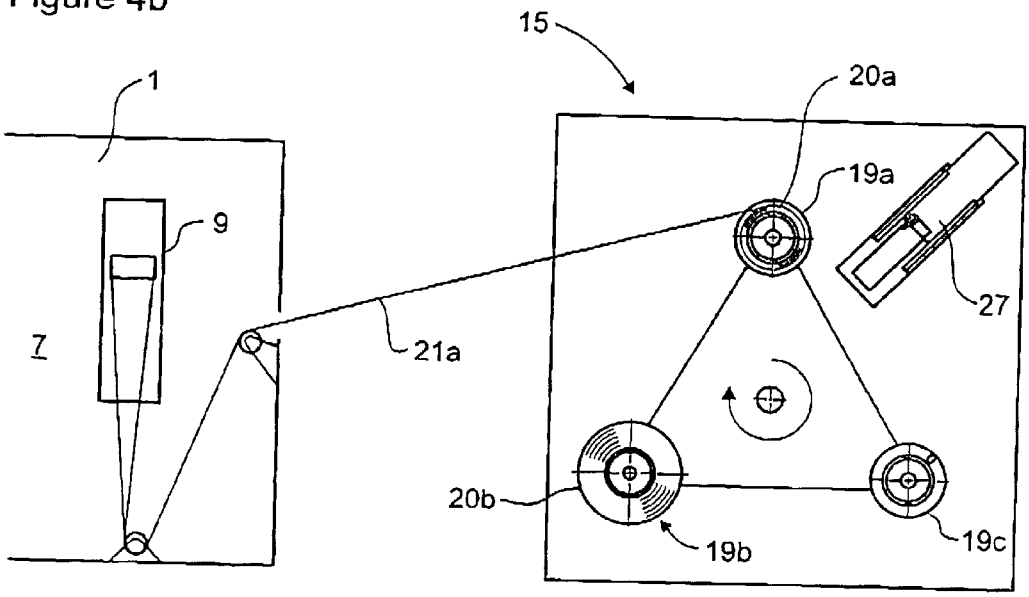

When the depleted roll sensor 24 detects a depleted condition of a roll of tape 20*a*, the control unit 23 controls the index drive 22 to rotate the platen 16 through one sector (defined as the angular separation between adjacent mandrels 19) in the direction indicated by the arrow in FIG. 4*b*. This rotation moves the next successive mandrel 19*b* and thus a fresh roll of tape 20*b* into the active position, and simultaneously moves the mandrel 19*a* carrying the depleted roll 20*a* out of the active position and past the cutting unit 27, while continuing to draw a web of tape 21*a* from the depleted roll 20*a*. The fresh roll of tape 20*b* being moved into the active position contacts the adhesive face of the web of tape 21*a* being drawn from the depleted roll 20*a*, which causes the fresh roll of tape 20*b* (and its mandrel 19*b*) to begin rotation. A previously formed tab on the free end of the fresh roll of tape 20*b* is thus brought into contact with the adhesive face of the web of tape 21*a* from the depleted roll, whereupon a web of tape 21*b* (bonded to the web 21*a* from the depleted roll) begins being drawn from the fresh roll 20*b*.

Upon detection of continued rotation of the mandrel 19*b* carrying the fresh roll of tape 20*b*, the control unit 23 activates the knife actuator 32 of the cutter unit 27 to quickly and forcefully drive the knife assembly 31 to the cutting position, thereby severing the web of tape 21*a* being drawn from the depleted roll 20*a* (FIG. 4*d*). The web of tape 21*b* continues being drawn from the fresh roll 20*b* after severing of the web from the depleted roll, thereby providing a continuous supply of the tape to the carton sealing machine 1. Following cutting of the web of tape 21*a* from the depleted roll 20*a*, the actuator 32 of the cutter unit 27 moves the knife assembly 33 to its retracted position so as to be ready for the next cycle.

It will be apparent to those skilled in the art that the present invention can varied without departing from the scope of the present invention. For example, the specific embodiment described in detail above comprised a platen having three mandrels. Those skilled in the art will recognize, however, that the present invention can be implemented with two or more mandrels. Similarly, the knife assembly 31 described above is of a "linearly actuated" type. It will be seen however, that a pivoting knife assembly would work as well. Indeed, virtually any means for reliably severing the web of tape from the depleted roll can be used with the present invention, the only restriction being that the tape cutting mechanism must not interfere with rotation of the platen during a tape splicing cycle. Thus it will be seen that the above-described embodiment is illustrative, rather than being limitative of the present invention.

What is claimed is:

1. A multi-roll automatic tape splicing device comprising:

(a) a support frame;

(b) a platen rotatably mounted on said support frame;

(c) a shaft rotatably supporting said platen and said frame;

(d) at least two tape mandrels rotatable on said platen, said mandrels being spaced equidistant from said shaft, and spaced apart from each other, each mandrel being adapted to receive a roll of tape;

(e) an index drive for selectively rotating the platen to successively move a mandrel carrying a fresh roll of tape into a predetermined operating position in which a web of tape can be drawn from the fresh roll of tape and for moving a mandrel carrying a nearly depleted roll of tape from which a web of tape is being withdrawn out of the operating position when the roll of tape is nearly depleted;

(f) a first sensor on the support frame for detecting a nearly depleted condition of a roll of tape in the operating position;

(g) a second sensor on the support frame for directly detecting rotation of a mandrel in the operating position at the moment when the roll of tape is drawn from the fresh roll of tape;

(h) a cutting unit on the frame for severing a web of tape being drawn from a nearly depleted roll of tape; and (i) a control unit responsive to the first and second sensors for actuating the index drive to rotate the platen, when said first sensor detects a nearly depleted condition of the nearly depleted roll of tape, thereby moving a mandrel carrying a fresh roll of tape into the operating position, whereby a tab on the end of the fresh roll of tape adheres to the web of tape being drawn from the nearly depleted roll causing a web of tape to be drawn from the fresh roll, and when the second sensor detects rotation of the mandrel carrying the fresh roll of tape in the operating position, the control unit immediately actuates the cutting unit to cut the web of tape being drawn from the nearly depleted roll.

2. A multi-roll automatic tape splicing device as claimed in claim 1 including three or more mandrels.

3. A multi-roll automatic tape splicing device as claimed in claim 1, wherein the platen is mounted for rotation in a substantially horizontal plane.

4. A multi-roll automatic tape splicing device as claimed in claim 1, wherein the platen is mounted for rotation in a substantially vertical plane.

5. A multi-roll automatic tape splicing device as claimed in claim 1, wherein the platen is mounted for rotation in a plane which is inclined with respect to horizontal.

6. A multi-roll automatic tape splicing device as claimed in claim 1, wherein the frame is a free-standing unit.

7. A multi-roll automatic tape splicing device as claimed in claim 1, wherein the frame is designed for mounting on a conventional carton sealing machine.

8. A multi-roll automatic tape splicing device as claimed in claim 1, wherein the index drive, platen and cutting unit define a splicing assembly.

9. A multi-roll automatic tape splicing device as claimed in claim 8, comprising a single splicing assembly for supplying a web of tape to a single tape head of a carton sealing machine.

10. A multi-roll automatic tape splicing device as claimed in claim 8, comprising two or more splicing assemblies for simultaneously supplying webs of tape to tape heads of one or more carton sealing machine.

11. A multi-roll automatic tape splicing device as claimed in claim 10, comprising a control unit for controlling each splicing assembly.

12. A multi-roll automatic tape splicing device as claimed in claim 10, comprising a single control unit for controlling all of the splicing assemblies.

* * * * *